United States Patent [19]

Grant

[11] Patent Number: 4,742,624

[45] Date of Patent: May 10, 1988

[54] SPIN DRYER

[75] Inventor: William P. Grant, Elgin, Ill.

[73] Assignee: Extractor Corporation, South Elgin, Ill.

[21] Appl. No.: 900,669

[22] Filed: Aug. 27, 1986

[51] Int. Cl.[4] ..... F26B 11/04

[52] U.S. Cl. ..... 34/58; 34/8; 188/166; 494/12; 494/84

[58] Field of Search ..... 34/8, 58; 68/23; 188/166; 494/12, 84

[56] References Cited

U.S. PATENT DOCUMENTS 4,412,390 11/1983 Grant ..... 34/58

*Primary Examiner*—Larry I. Schwartz

*Attorney, Agent, or Firm*—James G. Staples

[57] ABSTRACT

An improved spin dryer having an improved braking system, vibration absorbing suspension system, and automatic power shut off system. This spin dryer is safe, inexpensive, and substantially free from vibration and noise. The spin dryer of this invention also contains a spin compartment which will stop spinning typically upon a slight upward movement of the lid and spin once again upon the release of a small downward press on the dryer lid.

4 Claims, 2 Drawing Sheets

Fig.1.
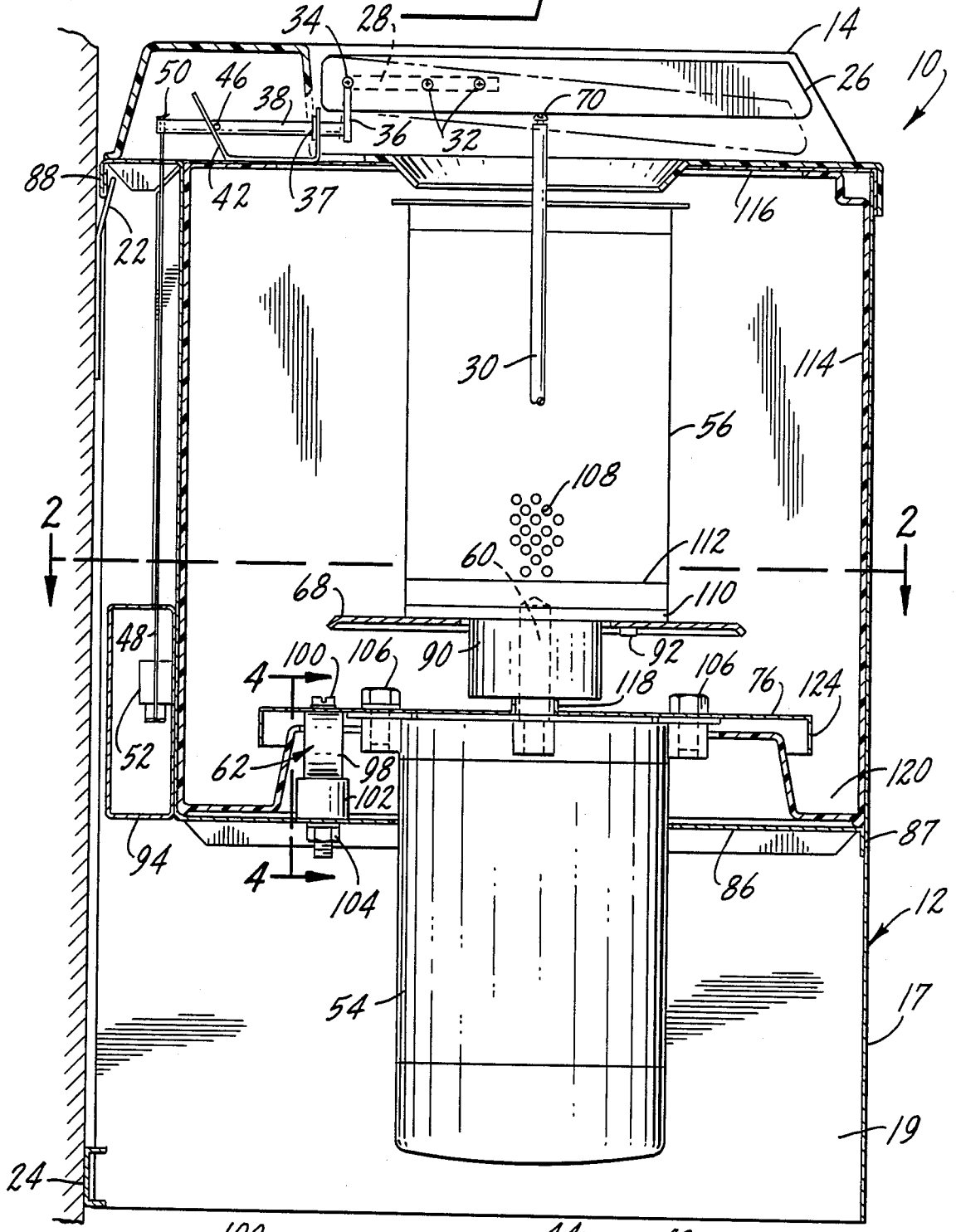
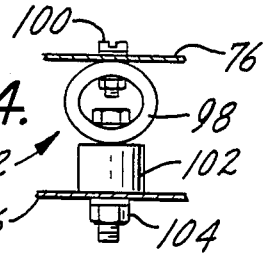
Fig.4.
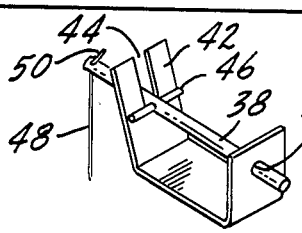
Fig.5.

SPIN DRYER

FIELD OF THE INVENTION

This invention relates to an improved spin dryer which uses centrifugal force to separate water from articles, typically clothing. More particularly, this improved spin dryer has an innovative design which provides for safer, quieter and more durable operation.

BACKGROUND OF THE INVENTION

This application is an improvement of a previous invention disclosed in Grant, U.S. Pat. No. 4,412,390, the disclosure of which is incorporated herein by reference.

Although the invention disclosed in U.S. Pat. No. 4,412,390, is well suited for its intended application, further improvements have been made. First, the design has been improved to further decrease vibration and noise during operation. Second, the improved design allows for even smoother operation by further decreasing the potential for uneven wear on interconnected parts. Finally, an even safer operating system is now possible due to an improved power shut-off mechanism and improved braking system.

Consequently, it is an object of this invention to provide a spin dryer which is free from vibration and noise.

A further object of this invention is to provide a spin dryer having an inner spin compartment which quickly begins to spin upon a downward push on the dryer lid below the lid's substantially horizontal "at rest" position, and quickly stops spinning once this downward push on the dryer lid is removed.

A further object of this invention is to create a spin dryer with a braking system which will quickly stop the inner spin compartment upon the release of a downward push on the spin dryer lid.

A further object of this invention is to provide a spin dryer having an automatic power shut-off system actuated by the release of a downward push on the spin dryer lid.

A further object of this invention is to provide a spin dryer having an automatic power cut-off system and an automatic braking system which are effective, durable, inexpensive, and easy to manufacture and maintain.

Other objects and features of this invention will become apparent to those skilled in the art from the following specification when read in the light of the annexed drawings.

SUMMARY OF THE INVENTION

The improved spin dryer of this invention utilizes an innovative design which enhances the dryer's low cost and low maintenance operation. The improvements include an improved braking system, vibration absorbing suspension system, and automatic power shut-off system.

DESCRIPTION OF THE DRAWINGS

The invention is illustrated more or less diagrammatically in the accompanying drawings wherein:

FIG. 1 is a vertical side view, in section, of the preferred embodiment with background parts and portions of the braking system omitted for clarity;

FIG. 4 is a view of the shock bumper assembly taken substantially along the line 4—4 of FIG. 1; and FIG. 5 is a perspective view of the riser and bracket assembly.

DESCRIPTION OF THE PREFERRED EMBODIMENT

Like reference numbers will be used to refer to like parts from figure to figure in the following description of the preferred embodiment of the invention.

In FIG. 1, the spin dryer is illustrated generally at 10. FIG. 1 is a side view of the preferred embodiment with portions omitted for clarity. Although brake mechanism 58 has been omitted in FIG. 1, it is shown in detail in FIGS. 2 and 3.

Figure 2:
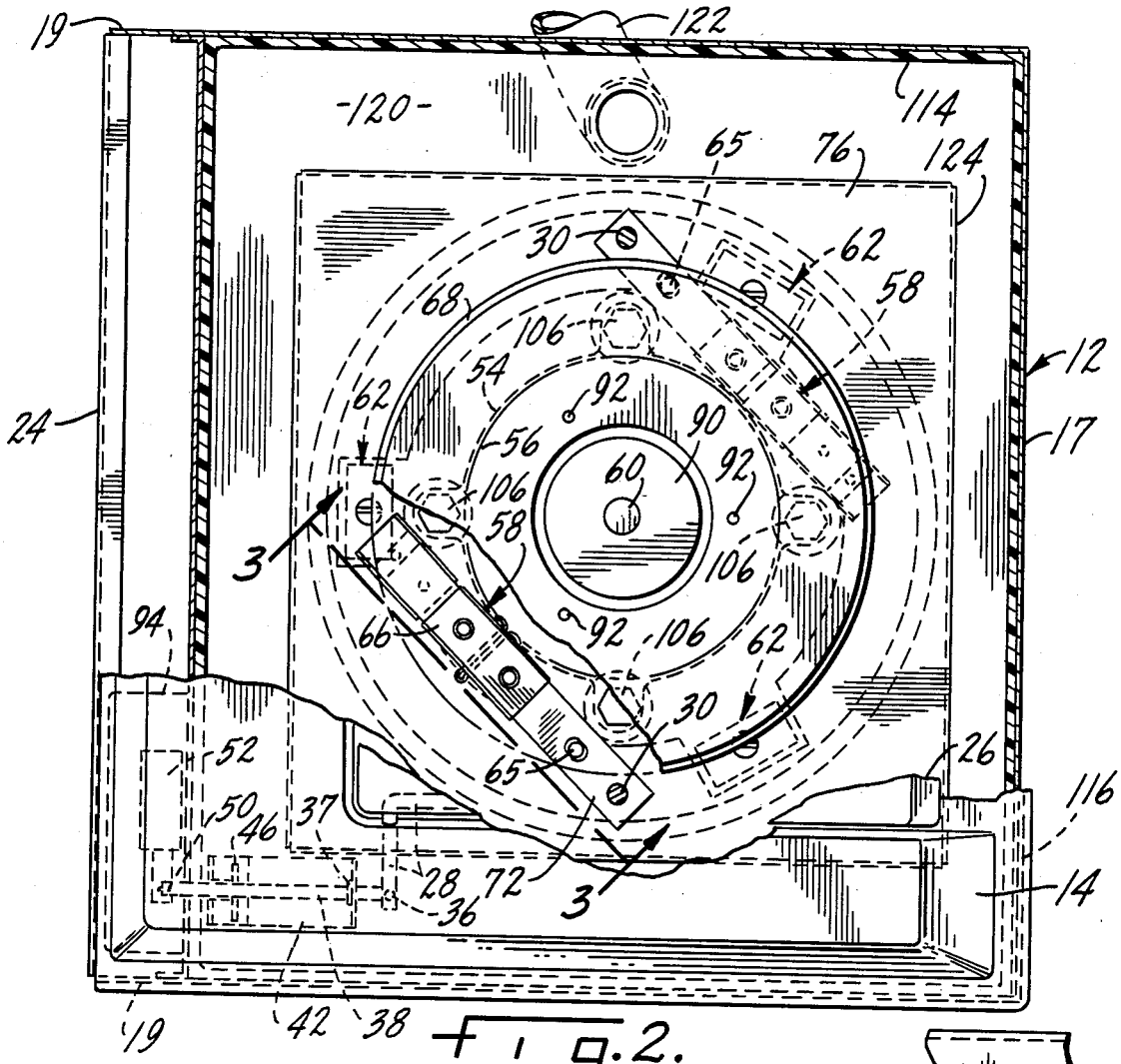
FIG. 2 is a top view of the dryer, including the braking system, with parts in section taken substantially along the line 2—2 of FIG. 1.

As illustrated in FIG. 2, two separate but identical braking systems are used, and the brake assemblies 58 lie across from one another on opposite sides of a motor drive shaft 60. This dual brake design has numerous advantages. First, the dual braking system can stop the spin compartment quickly; indeed, the spin compartment typically stops within 1 second after the brakes are actuated. Second, the brake design is very reliable. Even in the unlikely event of total brake failure by one brake system, the second brake alone is typically able to stop the spin compartment within 2 seconds after activation. Third, this brake design creates a more balanced braking force which results in low vibration and less uneven wear during use. Finally, this dual brake design balances the brake release force evenly on each side of the motor drive shaft and thereby produces a more evenly distributed force upon shock bumper assemblies 62 which support the brake assemblies 58.

Figure 3:
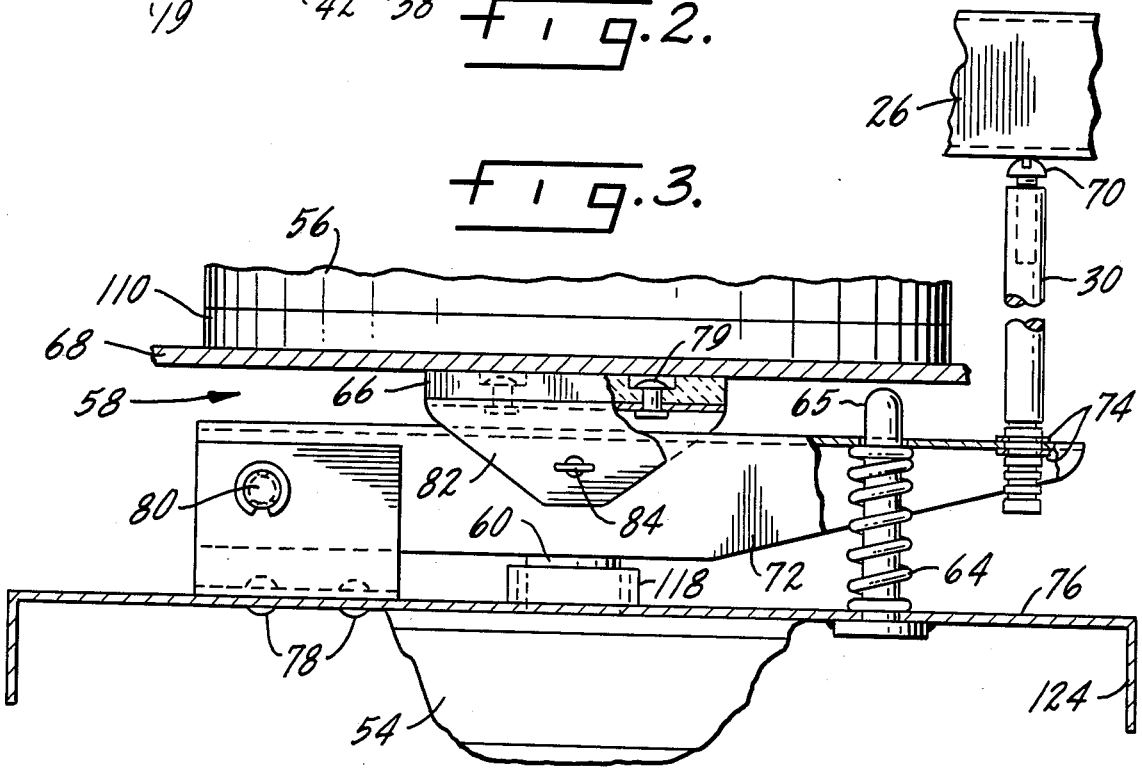
FIG. 3 is a view to an enlarged scale, showing the dryer brake mechanism, taken substantially along the line 3—3 of FIG. 2.

As shown in FIGS. 2 and 3, each brake system has a vertical brake rod 30. The brake rods are preferably aligned beneath opposite sides of the lid with each brake rod being about the same distance from the lid's pivoting edge; these brake rods support the lid when the lid is in its substantially horizontal "at rest" position.

The bottom of brake rods 30 have notched grooves and are connected to rocker arms 72 by metal rings 74. The metal rings 74 slide into the notched grooves and are placed above and below where the brake rod protrudes through each rocker arm 72. Brake rods 30 are thereby firmly attached to rocker arms 72; however, the connections are not so rigid as to create wear from any wobbling of the brake rods during use.

When the front of the lid is pressed downward below the "at rest" position, brake rods 30 are also pushed downward; this in turn pushes rocker arms 72 downward against the bias of compression springs 64, causing the rocker arms to pivot downward about pivot points 80. The downward movement of the rocker arms pull rocker arm brake pads 66 downward away from braking disk 68. The braking system is thereby disengaged.

Rocker arms 72 are fastened to cover plate 76 by fasteners 78. The compression spring is held in place by spring support 65. Brake pads 66 are fastened to pivot supports 82 by fasteners 79 which lie partially recessed within brake pads 66.

In the absence of a downward force by brake rods 30, i.e. when the downward force on the front of the lid is removed, the compression springs push the brake rod and rocker arm assemblies upward, causing the lid to return to the "at rest" position and causing the braking system to engage. As the rocker arms 72 pivot upward about rocker arm pivot 80 under the impetus of compression spring 64, pivot supports 82 pivot about secondary pivots 84, allowing brake pads 66 to contact flush against the lower surface of brake disk 68.

Brake disk 68 has a downward protruding hub 90 and an upward protruding circular portion 110; the upward protruding circular portion 110 is fastened to brake disk 68 by fasteners 92.

This upward protruding circular portion 110 has an outer circumference slightly smaller than the inner circumference of the spin compartment. The sides of spin compartment 56 extend below the bottom of the spin compartment, creating a receiving well into which upward protruding circular portion 110 of brake disk 68 can be inserted; the brake disk and spin compartment are thereby fastened together. In this way, the spin compartment and brake disk are interconnected to spin in unison. Motor drive shaft 60 also spins in unison with the spin compartment and brake disk, because the drive shaft is secured within a central aperture of brake disk hub 90. Braking the rotating brake disk 68 therefore also brakes the drive shaft 60 and spin compartment 56, allowing for high uniform friction when the brake disk comes in contact with brake pads 66. This braking system is simple, reliable, and durable.

The braking is preferably symmetrical with each braking system on opposite sides of the drive shaft. To achieve this symmetry, the rocker arms typically must each pivot in opposite directions or, in other words, face in the same clockwise or counter-clockwise position as shown in FIG. 2.

Uniform braking decreases wear on the drive shaft and drive shaft support members. To accomplish this uniform braking, the brake rod lengths can be adjusted by height adjustment screws 70 to ensure that both brakes disengage together as the front of lid 26 is pressed below the "at rest" position and conversely, re-activated together as the downward pressure on the front of the dryer lid is removed. Adjusting the height of each brake rod is quite simple, because it merely requires a twisting of the brake adjustment screw 70 with a conventional screwdriver.

The height of the brake rods are preferably adjusted not only to have the brake mechanisms work in unison, but also to cause the brake mechanisms to engage and disengage at the proper moment. The brake should engage only after power is cut to the spin motor; otherwise the motor would attempt to spin against the braking force of the brake system, causing unnecessary wear on the motor and braking system. The brake should also disengage before power is once again supplied to the spin motor; otherwise the motor would once again attempt to spin against the braking force of the brake system, again causing unnecessary wear on the motor and braking system.

In its "at rest" position, lid 26 is supported at the sides by brake rods 30 and at the rear by two hinge pins. The left hinge pin is shown at 28, and the right hinge pin is not shown in FIG. 1.

A horizontal top panel 14 has a central opening within which lid 26 is positioned when it is placed in its substantially horizontal or "at rest" position. This central opening has a peripheral downward boundary portion which closely borders around lid 26 when the lid is at rest.

Each hinge pin supports the lid in exactly the same way but at opposite sides of the lid's rear portion. As illustrated in FIG. 1, left hinge pin 28 is fastened to lid 26 by fasteners 32. The hinge pins have horizontal outwardly projecting right angle portions which protrude through the respective adjacent vertical boundaries of top panel 14, thereby providing a hinge for lid 26 and allowing the lid to pivot rearwardly about pivot point 34.

Up to this point, the two hinge pins act together as mirror images of one another. However unlike the right hinge pin which is not illustrated, the outwardly projecting portion of the illustrated left hinge pin 28 has an actuator pin 36 fastened perpendicularly to it. The lid and actuator pin therefore pivot together in unison about pivot point 34. The pivoting motion of actuator pin 36 is used to apply a gradually increasing rearward force on shuttle 38 as lid 26 pivots downward from the substantially vertical open position. Conversely, the rearward force on the shuttle actuator pin 36 gradually decreases as lid 26 pivots upward to the substantially vertical open position.

Shuttle 38 is supported at essentially two points. On the forward end of shuttle 38, the shuttle is supported in an aperture 40 (see FIG. 5) of riser bracket 42; the aperture is preferably lined with smooth metal 37 to decrease friction. The rearward or "cable" end of shuttle 38 is also supported by riser bracket 42 in a slot 44 (see FIG. 5) which inclines upwardly and rearwardly.

As shown in FIG. 5, a shuttle pin 46 protrudes from both sides of shuttle 38 and contacts the upwardly and rearwardly inclined surfaces which flank slot 44.

Consequently as shown in FIG. 1, when shuttle 38 is pushed rearwardly by actuator pin 36, i.e. when the lid is closed, shuttle pin 46 cannot slide through slot 44, but rather is pushed upwardly and rearwardly along slot 44.

The rearward or "cable" end of shuttle 38 is connected at the top to a stainless steel nylon covered flexible cable 48 by top clip 50. As shown in FIG. 1, this cable runs from this point, through a vertical aperture in shuttle 38, and down to micro-switch 52 to which it is secured. Micro-switch 52 has a spring portion which creates a downward pull on cable 48.

As lid 26 moves up, actuator pin 31 pivots away from the shuttle, allowing gravity and the downward pull of cable 48 to move the shuttle down the riser. As the shuttle moves downward, the cable also moves downward which in turn causes micro-switch 52 to cut power to dryer motor 54.

Conversely, as the lid is pressed below the "at rest" position, the shuttle and the cable move upward, causing micro-switch 52 to restore power to dryer motor 54. Once the downward force on the front of the lid is removed, the lid returns to its horizontal "at rest" position and the resulting downward movement of the shuttle and cable causes micro-switch 53 to cut power to motor 54.

It can thus be seen that this mechanism is inexpensive, simple, and durable. The interconnected parts of the power cut-off mechanism are not prone to excessive wear. One important feature is that only a slight pivoting movement by activator pin 36 (caused by the pivoting of the lid) can cause a significant vertical movement of the cable end of shuttle 38 due to the incline of slot 44. Where the incline is greater than 45 degrees from the horizontal, the shuttle's vertical movement at the cable end will be greater than the shuttle's horizontal movement. The vertical movement is a function of the slot angle, and the increment of vertical movement can be increased by increasing the riser bracket angle up to nearly 90 degrees. Consequently, the angle of the riser bracket can be varied to adjust the vertical movement of the cable as the lid is pressed below the "at rest" position and later, as the lid is released.

Micro-switch 52 has a region of uppermost pull where the switch is in the "on" position; once the pull upon the switch is relaxed somewhat, the switch goes to the "off" position. Consequently, as the front of the lid is pressed down, the riser bracket design allows lid 26 to create sufficient vertical upward movement upon the cable end of shuttle 38 which thereby causes switch 52 to provide power to motor 54. Conversely, when the lid is released, due to the riser bracket design, only a slight upward movement of the lid can create sufficient vertical downward movement by the cable end of shuttle 38 to cause switch 52 to cut power to motor 54.

The pull on micro-switch 52 must correspond with the position of the dryer lid. As the lid is pushed down below the at rest position, the lid presses the brake rods, causing the brake pads to pull away from the brake disk and thereby disengaging the braking system. As the lid goes down even further, the shuttle pulls the cable upward even further to then cause the switch to supply power to the spin motor.

The lid is then held in this position as the spin compartment spins, and water is extracted from the articles contained therein. Once spin drying is complete, the lid is released. Due to the force of the compression springs on the brake rods, the brake rods push the lid upward to the "at rest" position; the upward movement of the lid relaxes the tension on the cable and causes the switch to cut power. Thereafter, the brake pads contact the brake disk due to the impetus of the compression spring.

The riser bracket design creates an on and off switching mechanism which is very sensitive to even a slight movement of the lid. The riser bracket can be varied to different angles to adjust the on and off switching of micro-switch 52 relative to the lid's position. Alternatively, the switching of micro-switch 52 can also be adjusted by adjusting the length of cable 48. Although these adjustments are very simple and easy, they are very important, because as the lid is pressed down and later released, the switch must provide power to the motor after the dual brakes are de-activated and must cut power to the motor before the brakes are once again activated.

As already mentioned, the length of each brake rod can be adjusted by height adjustment screw 70. This allows the lid position to be adjusted relative to the engaging and disengaging of the braking system. Consequently, the angle of the riser bracket, the length of the cable, and the height of the brake rods are instrumental in providing a spin dryer with a spin compartment which quickly spins upon the downward press of the dryer lid and quickly stops spinning upon the release of the downward press.

As shown in FIG. 1, the spin dryer also has an internal structural support indicated at 86. The front portion of support 86 is fastened to the inner wall of front panel 17 as illustrated at 87. The rear portion of support 86 is fastened to the top inside rear portion of side panels 19 as illustrated at 88.

Support 86 supports shock bumper assemblies 62. These assemblies in turn support cover plate 76; cover plate 76 supports motor 54, brake disk 68, brake assembly 58 (See FIG. 2), and spin compartment 56. By supporting cover plate 76 therefore, the shock bumper assemblies 62 ultimately support those spin dryer components which primarily cause vibration due to spinning and braking.

As shown in FIG. 2, the preferred embodiment contains three such shock bumper assemblies. The assemblies are fastened at the bottom to support 86 and at the top to cover plate 76. Each assembly is positioned equidistant from motor shaft 60, and 120 degrees apart from one another.

As illustrated in FIG. 4, the top of each bumper assembly 62 has a shock bumper ring 98 which is fastened to cover plate 76 by fastener means 100. The bottom of each shock bumper ring is fastened to a conventional shock mount 102 by fastener 104. The shock mount in turn is fastened to support 86 by fastener 105.

Under the weight of the load they support, the shock bumper rings 98 are sufficiently rigid to maintain a somewhat oval or oblong shape as illustrated in FIG. 4. Any downward forces during operation typically will further compress the shock bumper ring 98 to an even more oblong position, but the rings have sufficient inherent rigidity to preclude the top and bottom portions from contacting one another. Once such downward forces are removed, each shock bumper ring 98 returns to its original position.

The bumper ring 98 is also capable of absorbing any horizontal or twisting forces during operation. In response to any such forces, the bumper ring 98 will twist and stretch. After these forces are removed, the bumper ring will again return to its original position. Consequently, any unbalanced forces or motor vibration during use will be substantially absorbed by the shock bumper assemblies 62.

Shock bumper assemblies 62 are inexpensive and durable. They have been found to dramatically decrease noise, vibration, and wear during spin dryer operation, thus increasing the useful life and enjoyment of the spin dryer.

The spin compartment 56 contains apertures 108 which allow excess water, extracted from wet articles, to leave the compartment during spinning. Although these apertures are located throughout the spin compartment, only a portion are shown in FIG. 1 for simplicity. The surrounding area outside spin compartment 56 is protected from this extracted water by plastic liner 114.

This liner substantially covers the inner cavity surrounding the spin compartment. A metal sub-top 116 has a top aperture above the spin compartment 56 and below lid 26 having a circumference substantially equal to that of the spin compartment. Liner 114 extends across a portion of the upper side of support 86 and comes up under cover plate 76 creating a bottom trough 120 which will ultimately collect any extracted water leaving the spin compartment through apertures 108. A drain 122, see FIG. 2, allows this extracted water to flow from trough 120 and discharge from the system.

As shown in FIG. 1, the motor is protected from extracted water by cover plate 76 and brake disk 68. At the center portion of cover plate 76, an upwardly directed lip 118 extends around motor drive shaft 60 and protrudes up into an area surrounded from above by brake disk hub 90. During normal operation, extracted water will not flow up under hub 90 and down over cover plate lip 118; consequently, extracted water will not be able to contact the motor by means of the opening in cover plate 76 through which the motor drive shaft 60 protrudes. Furthermore, cover plate 76 has an outer peripheral lower lip 124 which further protects the components under cover plate 76 from extracted water.

The dryer has a housing 12 comprising top panel 14, front panel 17, and and side panels 19. The bottom of the housing is left open, exposing the motor; this allows proper ventilation to the motor and prevents overheating. The device does not require a rear panel, because the device is preferably permanently mounted to a vertical structure such as a wall with the rear side edges of the dryer in contacting relationship to the vertical structure.

The dryer is adapted to wall mounting, because the top rear portion of the dryer has a vertical lip 88 extending down about an inch or two from the rear top edge of the dryer, and this lip lies across the width of the rear portion of the dryer. Once a wall mount hook 22 is secured to the vertical structure, the rear lip 88 can be hooked over wall mount hook 22.

At the bottom rear portion of the dryer is a mounting channel 24 which is fastened to the inside rear edges at the bottom of both side panels 19. This horizontal mounting channel 24 therefore bridges across the side panels at their lower rear edges.

This mounting channel has mounting apertures along its length, and provides a rearward outside surface which will lie substantially flush against the vertical mounting structure. Since the bottom of the spin dryer is left open, the inside surface of the mounting channel is exposed. The mounting channel can therefore be fastened to the vertical structure with conventional fasteners such as rivots or screws through the mounting channel's mounting apertures and into the vertical mounting structure.

The foregoing detailed description has been given for illustration purposes only. A wide range of changes and modifications can be made to the preferred embodiment described above. It should therefore be understood that it is the following claims, including all equivalents, which are intended to define the scope of this invention.

I claim:

1. In an improved spin dryer having in combination a housing means defining an interior cavity and a pivoting lid in combination with a first opening in a first wall of said housing through which the interior cavity is accessible, motor means mounted within the interior cavity and having a power switching means and a rotatable shaft means, spin compartment means for receiving wet articles to be spun dry being connectable to the rotatable shaft means, braking means capable of impeding rotational movement of said spin compartment, the improvement comprising:

a shuttle and bracket assembly in mechanical connection with said pivoting lid wherein the pivoting movement of said lid causes said shuttle to move along an incline defined by said bracket;

means for attaching said shuttle to said switching means wherein the movement of said shuttle causes said switching means to alter power to said motor.

2. The improved spin dryer of claim 1 wherein:

said switching means connects power to said motor upon a downward pressing of said lid below the lid's substantially horizontal at rest position;

said switching means disconnecting power to said motor upon a downward pressing of said lid below the lid's substantially horizontal at rest position;

said switching means disconnecting power to said motor upon the release of said lid;

said braking means disengaging just prior to said switching means connecting power to said motor; and said braking means engaging just subsequent to said switching means disconnecting power to said motor.

a shuttle and bracket assembly in mechanical connection with said pivoting lid wherein the pivoting movement of said lid causes said shuttle to move along an incline defined by said bracket.

3. An improved spin dryer having in combination a housing means defining an interior cavity and a first opening in a first wall of said housing through which the interior cavity is accessible, motor means to be mounted to a cover plate within the interior cavity and having a power switching means and a rotatable shaft means, spin compartment means for receiving wet articles to be spun dry being connectable to the rotatable shaft means, braking means capable of impeding rotational movement of said spin compartment, the improvement comprising:

at least one shock bumper assembly;

said shock bumper assembly comprising a flexible and resilient O-shaped ring wherein said O-shaped ring is fastened at the top to said cover plate and at the bottom to a shock mount, said shock mount being secured by a separate fastener to an internal support, said support being secured to said housing:

said braking means having a rotatable disc-type brake plate means mounted to said rotational shaft means;

a pivotal lever means having one end which is biased toward engagement with said brake plate means;

said bias of said lever being created by a compression spring;

said braking means having post means connected to said biased end of said lever;

said post means being moveable upon contact by said lid; and downward movement of said lid below its at rest position causing said post means to act against the bias of said lever, disengaging a brake pad means from said rotatable disc-type plate means.

4. An improved spin dryer having in combination a housing means defining an interior cavity and a first opening in a first wall of said housing through which the interior cavity is accessible, motor means to be mounted to a cover plate within the interior cavity and having a power switching means and a rotatable shaft means, spin compartment means for receiving wet articles to be spun dry being connectable to the rotatable shaft means, braking means capable of impeding rotational movement of said spin compartment, the improvement comprising:

a shuttle and bracket assembly in mechanical connection with said pivoting lid wherein said shuttle moves along an incline defined by said bracket;

means for attaching said shuttle to said switching means wherein the movement of said shuttle causes said switching means to alter power to said motor;

said means for attaching said shuttle to said switching means being adjustable;

said switching means connecting power to said motor upon a pressing of said lid below its substantially horizontal at rest position;

said switching means disconnecting power to said motor upon the release of said lid;

said braking means disengaging just prior to said switching means connecting power to said motor;

said braking means engaging just subsequent to said switching means disconnecting power to said motor;

said spin dryer having at least one shock bumper assembly;

said shock bumper assembly comprising a flexible and resilient O-shaped ring;

said O-shaped ring being fastened at the top to said cover plate and at the bottom to a shock mount, said shock mount being secured by a separate fastener to an internal support connected to said housing;

said braking means having a rotatable disc-type brake plate means to be mounted to said shaft means for rotation;

said housing supporting a pivotal lever means having one end which is biased toward engagement with said brake plate means;

said bias of said lever created by a compression spring;

said post means connected to an end of said lever by means of ring fasteners;

said post means being moveable upon contact with said lid as the lid moves below its at rest position, said post moving said lever against the bias thereof for selectively releasing engagement between the brake plate means and a brake pad means;

a top portion of said post comprising a threaded aperture whereby an adjustment screw can be vertically engaged, thereby allowing the length of the post to be adjustable.

* * * * *